United States Patent [19]

Cummings

[11] 4,416,593

[45] Nov. 22, 1983

[54] GAS OPERATED DOWN HOLE PUMP

[76] Inventor: Leslie L. Cummings, 4018 W. Alabama, Houston, Tex. 77027

[21] Appl. No.: 180,426

[22] Filed: Aug. 22, 1980

[51] Int. Cl.[3] ..... F04B 47/08

[52] U.S. Cl. ..... 417/344; 417/393; 91/346; 91/536

[58] Field of Search ..... 417/393, 404, 403, 246, 417/339, 344, 347; 91/346, 536

[56] References Cited

U.S. PATENT DOCUMENTS

| | | | |
|---|---|---|---|
| 1,887,736 | 11/1932 | Scott | 417/403 |
| 1,907,949 | 3/1933 | Gage | 417/403 X |
| 1,963,472 | 6/1934 | Penrod | 91/346 X |
| 2,296,582 | 9/1942 | Sproull | 417/403 X |
| 3,617,152 | 11/1971 | Cummings | 417/54 |
| 3,846,048 | 11/1974 | Robbins | 417/393 |
| 4,295,801 | 10/1981 | Bennett | 417/403 |

OTHER PUBLICATIONS

Otis 2" Insert Gas Pump Assembly, Part No. 250062, Otis Engineering Corporation, Dallas, Tex., Prior Art Statement.

*Primary Examiner*—Leonard E. Smith

*Attorney, Agent, or Firm*—Vaden, Eickenroht, Thompson, Bednar & Jamison

[57] ABSTRACT

Double acting, gas operated pumps for lifting formation fluids from a well are disclosed as comprising a housing connectible to the lower end of a production string suspended within a well, and a pump assembly which may be lowered into and raised from a landed position within the housing. Upper and lower pump chambers are formed in the pump assembly and a piston is reciprocable in each chamber in response to the alternate supply and exhaust of a pressurized gas to one side thereto for alternately admitting formation fluid to the other side of one piston while pumping it from the other. The spool of a reversing valve for controlling the flow of gas to and from the chambers is connected to one of the pistons in such a manner that it is shifted into its alternate positions with a snap action.

14 Claims, 17 Drawing Figures

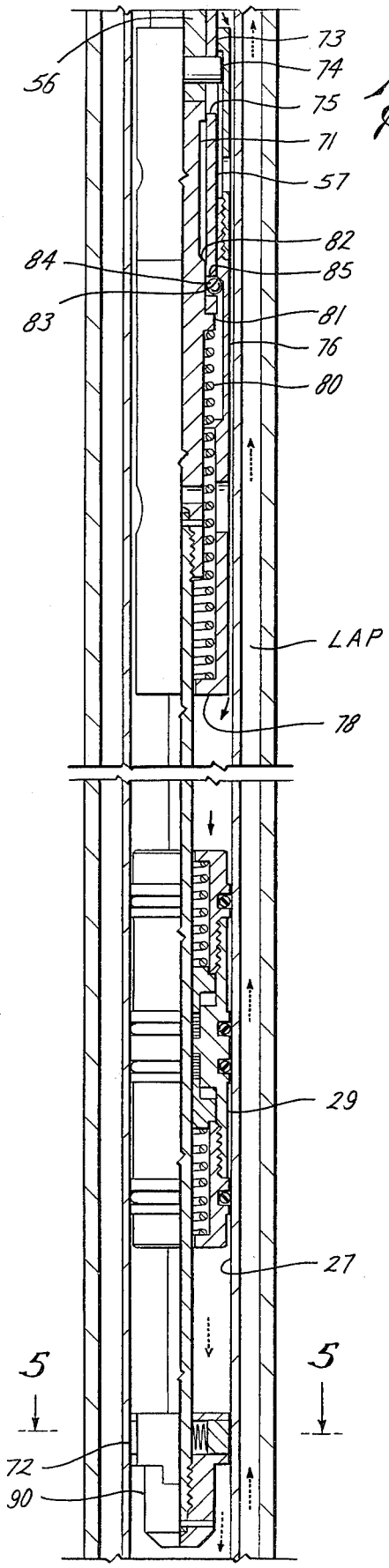
Fig. 1C
Fig. 1D
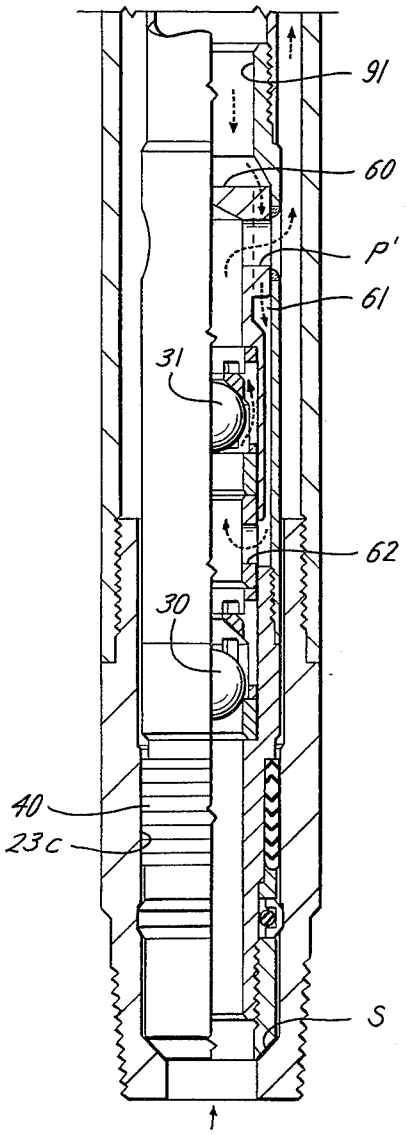

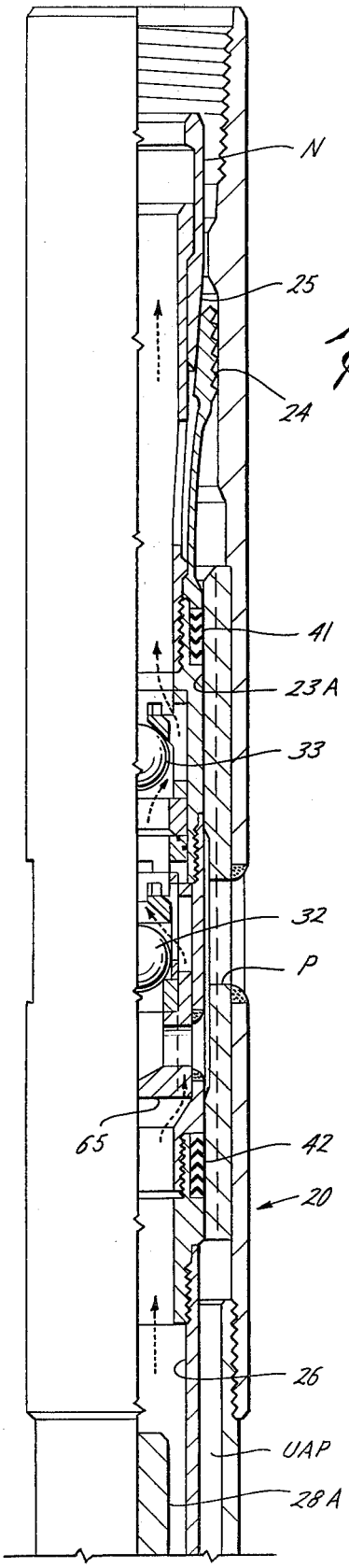
Fig. 7A
Fig. 7D
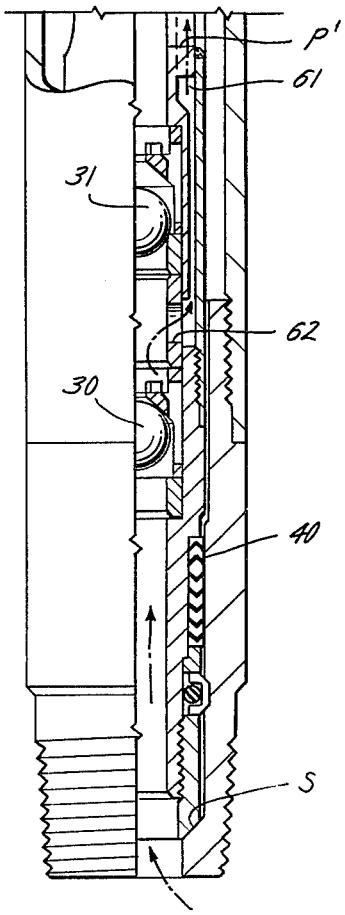

GAS OPERATED DOWN HOLE PUMP

This invention relates in general to gas operated, reciprocating pumps which are connectible to the lower end of a production string suspended within a well for the purpose of lifting formation fluid from the well. More particularly, it relates to improvements in pumps of the type shown and described in my U.S. Pat. No. 3,617,152.

In the pump of my prior patent, a pressurized gas is alternately supplied to and exhausted from a pump chamber on one side of a piston sealably slidable in the chamber, so that, when the gas is being exhausted therefrom, formation fluid may be admitted to the chamber on the other side of the piston, and, when the gas is being supplied thereto, the formation fluid admitted to the chamber on the other side of the piston may be pumped therefrom into the upper end of the housing and thus into the production string. Means including a reversing valve is provided for alternately supplying gas to the chamber through one tube which extends downwardly along the production string from a source of the gas at surface level or other remote location, and exhausting gas from the chamber to the annulus between the string and the casing or other zone of low pressure through another tube extending upwardly along the production string. The spool of the reversing valve is shiftable between its alternate positions by a connection to the piston in the pump chamber, and suitable standing and travelling valves prevent the admission of formation fluid to the pump chamber during the pumping stroke of the piston, and formation fluid from being displaced from the chamber during the exhaust stroke. A pump of this type is highly efficient in that it operates only so long as the hydrostatic pressure of the formation fluid is sufficiently higher than that of the exhausted gas as to move the piston in a direction to permit the pump chamber to fill.

In the pump of my prior patent, the standing and travelling valves are contained within a first pump assembly which is adapted to be lowered into and retrieved from landed position within a housing or receiver connectible to the lower end of the production string, and the reversing valve is contained within a second pump assembly adapted to be landed within and retrieved from the housing above the first assembly, with the piston carried by the rod connected to the spool of the reversing valve being seal slidable within a pump chamber formed in the bore of the housing. Hence, it is necessary to make two trips in order to land and retrieve the pump assemblies. Although in another prior pump of this type, the standing and travelling valves were contained in the same pump assembly with the reversing valve, pump chamber and piston, thereby necessitating only a single trip in either landing or retrieving, the piston moved upwardly within the pump chamber during the pumping stroke. There are occasions in which operators prefer that the piston be moved downwardly during the pumping stroke, and it is therefore one object of this invention to provide a pump of this type in which the pump assembly is landed and retrieved as a unit, and wherein the piston moves downwardly during the pumping stroke.

A further object of this invention is to provide a pump of this type which is double acting and thus has substantially twice the capacity of the prior pumps of this type, and in which, if desired, the entire pump assembly may be landed and retrieved as a whole, as in the case of the aforementioned single acting pump.

Ordinarily, however, the pump assembly will be lowered into and raised from the production string through a lubricator at the wellhead. In the event the pump chambers are of considerable length, as may be desired in order to increase the pump's efficiency, the standard lubricator may not be of sufficient length to handle the pump assembly of such a double acting pump. It is therefore still another object to provide such a pump in which the pump assembly is made up of two sections of substantially equal length each of which contains a long pump chamber and may be separately passed through a lubricator of not substantially greater length than each such section.

In pumps of this type, the spool of the reversing valve has a tendency to stall prior to finishing its stroke. In the pump shown in my prior patent, as well as in another version of a pump of this type, above described, mechanisms were provided for storing and releasing energy within a spring, automatically in response to reciprocation of the piston into its alternate positions, in order to quickly shift the spool of the reversing valve with a snap action. However, the prior mechanisms for this purpose were either inefficient or of extremely complex construction, or both, and it is therefore yet another object of this invention to provide such a mechanism which is efficient and of simple and inexpensive construction.

In the pump above described, formation fluid in the production string was aerated by means of pressurized gas supplied to the column through a tube extending along the outside of the housing. A still further object of this invention is to provide a pump of this type having a simpler and less expensive means for aerating the column and thus assisting the available gas pressure in lifting the formation fluid in the production string.

These and other objects are accomplished, in accordance with the illustrated embodiments of the present invention, by a pump of the type described wherein means including a reversing valve is disposed within the pump assembly above the pump chamber therein, the reversing valve being movable between a first position for delivering gas supplied through one exterior tube to the chamber on the upper side of the piston in order to pump fluid therefrom as the piston is lowered, and a second position for exhausting gas from the chamber on the upper side of the piston through another exterior tube in order to fill the chamber with formation fluid as the piston is raised, and a means being provided for connecting the reversing valve to the piston in order to shift it between its first and second positions in response to reciprocation of the piston.

The means which connects the chamber on the lower side of the piston with the upper end of the housing includes a passageway formed between the housing and the pump assembly, when the pump assembly is landed within the housing, in order to bypass the reversing valve above the chamber. More particularly, a flow passage is formed through a reduced inner diameter portion of the housing in which the pump assembly is sealably received to connect with annular passageways between the pump assembly, and housing above and below the reduced portion, and ports are formed in the reduced portion to cross over the flow passage in order to connect the ends of the tubes with the interior of the housing portion, and thus with the reversing valve within the pump assembly. Still further, small amounts of gas are bled to the formation fluid in the production string, whereby the formation fluid is aerated to assist the pressurized gas in lifting it, through means formed within the pump assembly itself, and thus without the need for an external tube.

In the preferred and illustrated embodiment of the invention, the pump is double acting, with the lower pump chamber on one side of the piston therein connecting with the lower end of the housing, and the upper pump chamber on the one side of the piston thereof connecting with a port in the side of the housing near its upper end, whereby each receives formation fluid from the well. Each chamber on such one side of the piston also connects with the upper end of the housing to deliver formation fluid to the production string, and valve means is provided for controlling the flow of formation fluid into and out of each pump chamber on the one side of the piston therein in order to prevent such fluid from being pumped therefrom as it is being supplied thereto, and to prevent such fluid from being supplied thereto as it is pumped therefrom.

Means including a reversing valve is provided for supplying the gas to one pump chamber on the other side of the piston therein while exhausting gas from the other pump chamber on the other side of the piston therein to a remote location, when the reversing valve is in a first position, and for supplying gas to the other chamber on the other side of the piston while exhausting gas from the one chamber on said other side of the piston, when the reversing valve is in the second position. Thus, with one piston connected to the reversing valve for shifting the reversing valve, both are reciprocated to cause formation fluid to be pumped from one chamber while the other chamber is being filled therewith.

The reversing valve is located intermediate the upper and lower pump chambers, and the lower pump chamber on one side of the piston is connected with the open, upper end of the housing by the above-described passageway which bypasses the reversing valve. Also, gas is supplied to and exhausted from the upper side of the piston in the lower pump chamber, whereby the piston pumps in a downward direction in the lower chamber, and the reversing valve is connected to the piston in the lower chamber. In one embodiment of the invention, all parts including the pump chambers, pistons, reversing valve, standing and travelling valves, etc., are carried by and contained within a pump assembly which is lowered as a unit into and raised from a landed position within the housing. In another embodiment, the pump assembly is made up of two sections each having a long pump chamber and means by which it may be separately landed and retrieved within the pump housing, the upper end of one and the lower end of the other having interfitting parts which, when interfitted, form passageways through which pumped fluid and pressurized gas may be circulated during operation of the pump.

The spool is shifted with a snap action by means of a mechanism which includes a first rod on which the piston is carried for longitudinal movement with respect thereto, such rod having a stop thereon which is engaged by the piston so as to move said first rod with the piston as the piston moves in a direction to pump formation fluid from the pump chamber in which it reciprocates, and a second rod which is connected to the spool for shifting the spool between its alternate positions, and which is arranged in end to end, coaxial relation with the first rod. A tube connects to and extends from the pump body to surround the adjacent ends of the rods, and means on the tube and second rod limit longitudinal movement of the second rod with respect to the tube to a distance corresponding to the longitudinal movement of the spool between its alternate positions. A sleeve surrounds the tube and the extension of the second rod from the tube, a means is provided on the second tube which is engageable by the sleeve to shift the spool from a first to a second position, as the sleeve moves in the other longitudinal direction, and a means is also provided on the sleeve for engagement by the piston in order to move the sleeve with the piston as the piston moves in the one longitudinal direction to shift the spool from its second to its first position.

More particularly, spring means is provided for acting between the first rod and the sleeve to urge the first rod in the one longitudinal direction and the sleeve in the other longitudinal direction, and shoulder means on the first rod faces in the one longitudinal direction, which shoulder means on the sleeve faces in the other longitudinal direction. More particularly, detent means is carried by the tube for lateral movement between a first position in which it is engaged with the shoulder means on the sleeve but disengaged from the shoulder means on the first rod, and a second position in which it is engaged with the shoulder means on the first rod but disengaged from the shoulder means on the sleeve. Thus energy is stored in and then released by this spring means to quickly move the sleeve in the other longitudinal direction, thus shift the spool from its first to its second position, as the first rod is moved with the piston in the other longitudinal direction, the movement of the sleeve with the piston in the one longitudinal direction again storing energy in the spring means until the detent means moves back from its second to its first position to release said energy so as to quickly move said first rod in said one longitudinal direction and thus shift said spool from its second to its first position.

In an alternative embodiment of the detent mechanism there are a pair of detent means spaced longitudinally of the tube, and a pair of shoulder means spaced longitudinally of each of the first rod and sleeve, respectively, one shoulder means of each pair cooperating with one shoulder means of the other pair and one detent means of the pair of detent means. This embodiment is preferable in the sense that the detent means provides a larger surface over which the load may be applied.

In the drawings wherein like reference characters are used throughout to designate like parts:

FIGS. 1A, 1B, 1C, and 1D are longitudinal sectional views of vertically successive portions of a pump constructed in accordance with the embodiment of the present invention wherein the pump assembly is a single unit, and during one stage of operation of the pump in which displacement of formation fluid is displaced from the lower pump chamber into the upper end of the housing while formation fluid is admitted into the upper pump chamber;

FIG. 2 is a cross-sectional view of the pump, as seen along broken lines 2—2 of FIG. 1A;

FIGS. 3 and 4 are cross-sectional views of other portions of the pump, as seen along broken lines 3—3 and 4—4 of FIG. 1B;

Figure 6:
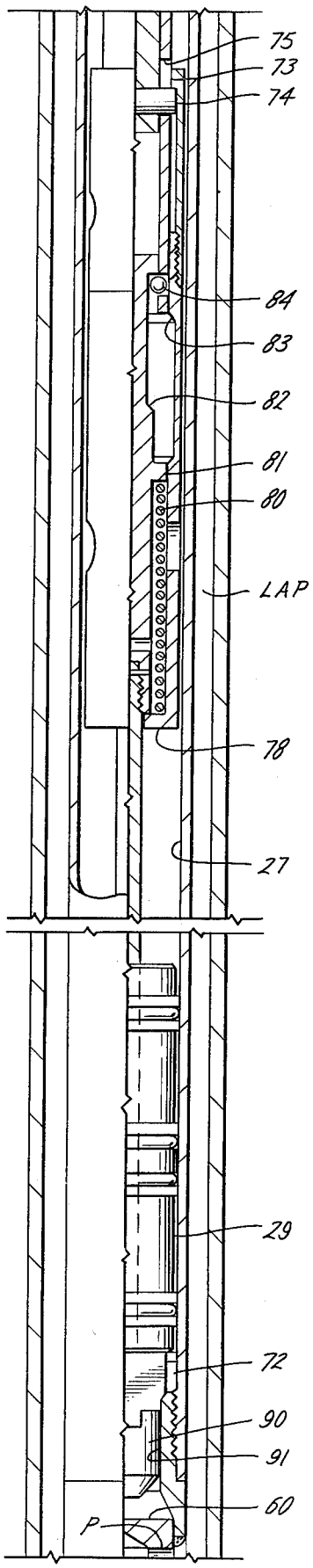
FIG. 6 is a longitudinal sectional view of the portion of the pump shown in FIG. 1C, but upon lowering of the piston in the lower pump chamber so as to shift the spool of the reversing valve from the upper position of FIG. 1B to its lower position.
Figure 7B:
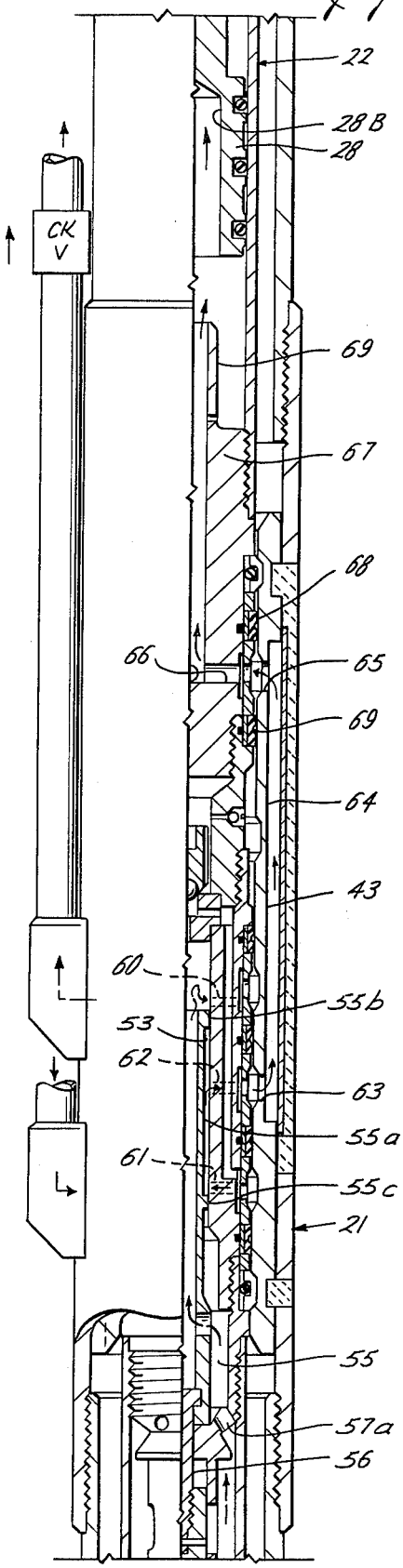
Figure 7C:
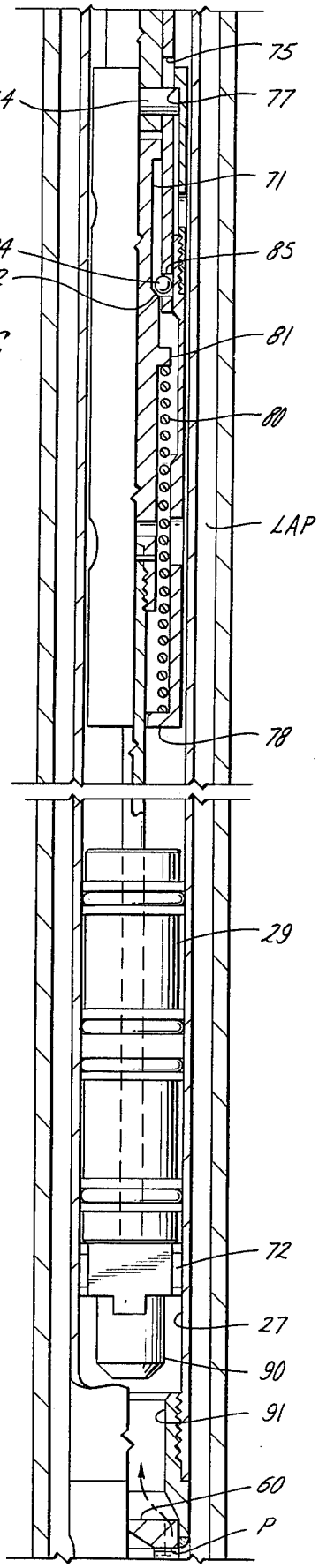
Figure 8A:
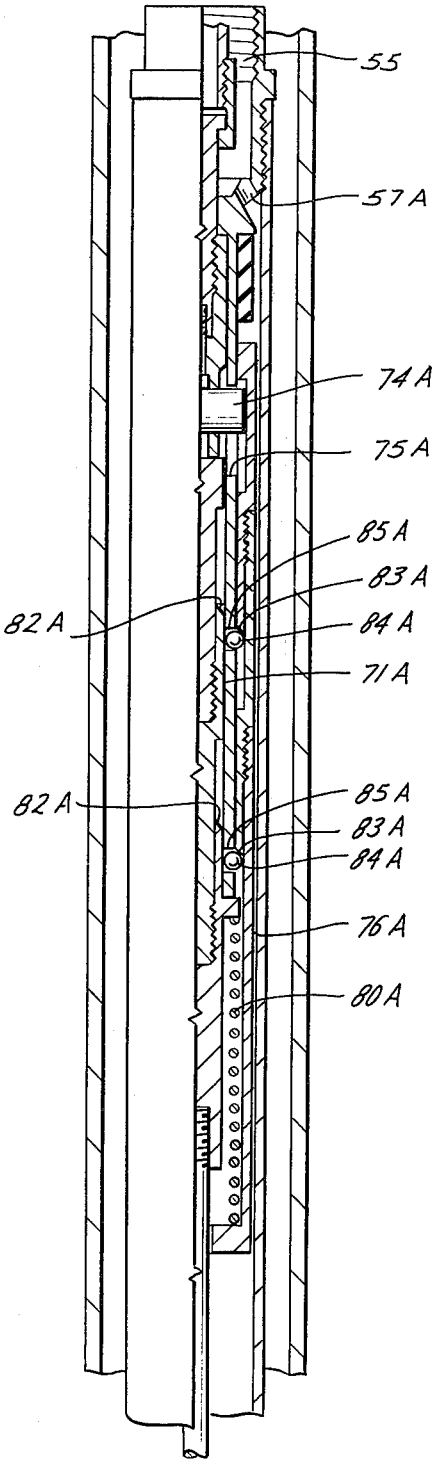
Figure 8B:
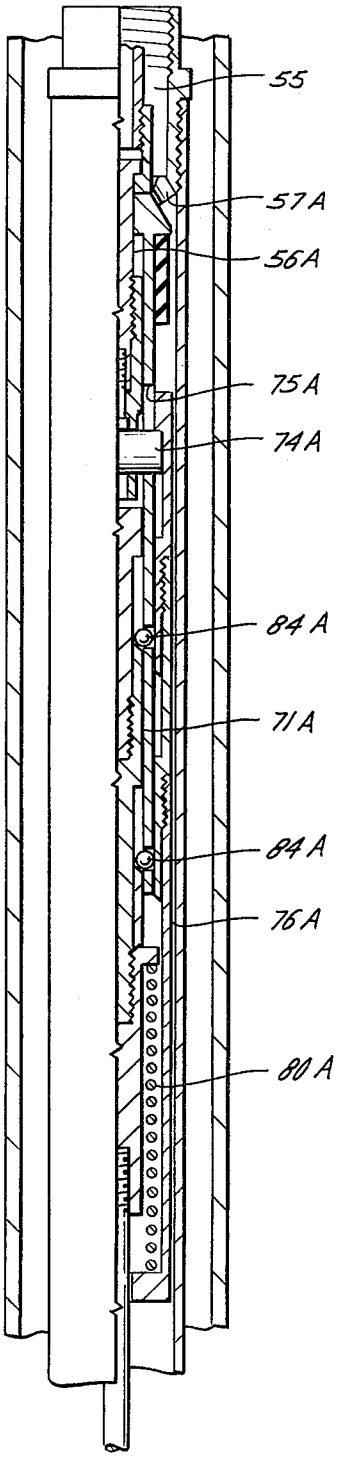
Figure 9A:
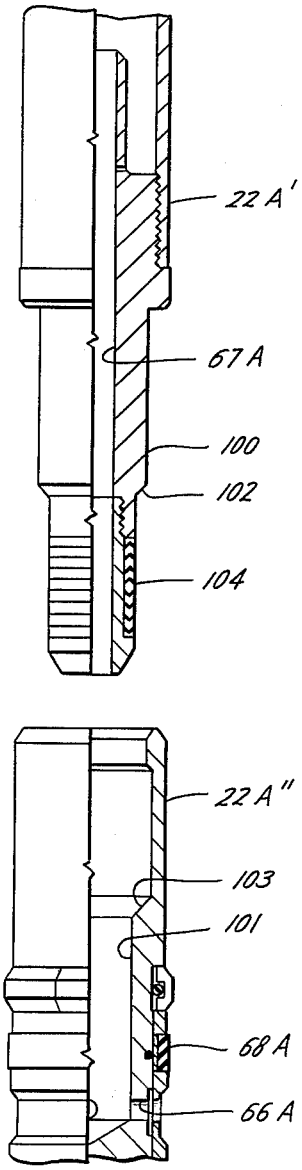
Figure 9B:
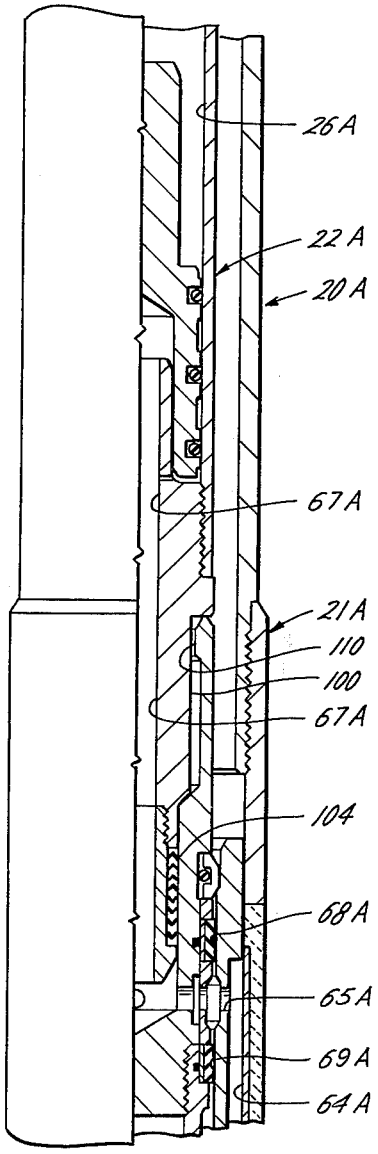

FIGS. 7A, 7B, 7C, and 7D are longitudinal sectional views of vertically successive portions of the pump, similar to FIGS. 1A, 1B, 1C, and 1D, but with the spool shifted to the lower position of FIG. 6 and during the other stage of operation of the pump in which formation fluid is displaced from the upper pump chamber into the upper end of the housing while formation fluid is admitted to the lower pump chamber;

FIGS. 8A and 8B are longitudinal sectional views of a slightly modified detent mechanism similar to that of FIGS. 1C and 7C for causing the reversing valve to be moved into its alternate positions with a snap action, FIG. 8A showing the detent mechanism in the position corresponding to that of the embodiment of the detent mechanism shown in FIG. 7C, and FIG. 8B showing the detent mechanism in a position corresponding to that of the detent mechanism shown in FIG. 7C; and FIGS. 9A and 9B are longitudinal sectional views of the upper and lower ends of the lower and upper sections, respectively, of the other embodiment of the pump, FIG. 9A showing such sections as the upper is lowered toward the lower, and FIG. 9B showing them interfitted.

With reference now to the details of the above-described drawings, the embodiment of the pump of FIGS. 1A–7D, which is indicated in its entirety by reference character 20, includes a housing 21 having threads at its upper end for connection to the lower end of a production string suspended within a well bore, and a pump assembly 22 retrievably landed within the housing for use in pumping formation fluid in the well bore into the upper end of the housing and thus the production string during both stages of operation in the pump. The lower end of the housing is also open so that, upon retrieval of the pump assembly, full access may be had to the well bore therebelow.

As shown, the housing is essentially tubular, with the exception of upper, lower and intermediate portions 23A, 23B, and 23C which have reduced inner diameters with parts of the pump assembly sealably engaged when landed within the housing. The pump assembly 22 is run into and retrieved from landed position within the housing by suitable wireline tools adapted to connect with and be released from a fishing neck N at the upper end of the pump assembly, and the lower end of the pump assembly is landed upon an upwardly facing seat S in the lower end of the housing. The pump assembly is releasably latched in landed position by a plurality of split latch rings LR which are yieldably urged into matching grooves G within the reduced inner diameter portions 23B and 23C of the housing. The pump assembly is also locked down in its landed position by means of spring fingers 24 carried about its upper end and urged outwardly into gripping relation with the inner diameter of the housing by means of an expander surface 25 on the lower end of the fishing neck N.

The pump assembly has upper and lower pump chambers 26 and 27 formed therein, with a piston 28 being sealably slidable within the upper chamber 26 and a piston 29 being sealably slidable within the lower chamber 27. During one stage of operation of the pump, and with the spool of the reversing valve in its upper position, as shown in FIGS. 1A–1D, pressurized gas is admitted to the lower chamber on the upper side of the lower piston 29 so as to displace fluid from the lower side of the piston into the upper end of the housing, and pressurized gas is exhausted from the upper chamber 26 beneath the piston 28 as formation fluid is admitted to the upper chamber on the upper side of the upper piston. Conversely, upon shifting of the spool to its lower position, and during the other stage of operation of the pump, pressurized gas is admitted to the upper chamber beneath the upper piston 28 to displace formation fluid from the upper chamber above the piston into the upper end of the housing, while pressurized gas is exhausted from the upper side of the lower piston to admit formation fluid to the lower chamber beneath the lower piston.

The lower end of the pump assembly is open, and a packing 40 carried thereabout sealably engages the bore of the lower portion 23C of the housing so that formation fluid entering the open lower end of the housing is confined to flow into the standing and traveling valve assembly which controls flow to and from the lower pump chamber 27. The upper reduced diameter portion 23A of the housing has ports P formed therein, and packings 41 and 42 carried about the pump assembly sealably engage the bore of such portion above and below the ports P and connecting ports in the pump assembly packings into the standing and traveling valve assembly which controls flow to and from the upper pump chamber 26.

As shown in FIGS. 1D and 7D, the lower of these assemblies includes a standing valve 30 which, during the first stage, is in its lower, seated position to close the lower pump assembly beneath chamber 27, and a travelling valve 31 above the standing valve, which, during this stage, is raised into engagement with a stop to permit formation fluid beneath piston 29 to be displaced from the chamber and thus into the upper open end of the housing. During this stage of operation of the pump, the standing valve 32 of the upper valve assembly is unseated so as to admit formation fluid through the ports P in the housing into the upper end of the upper chamber 26, and the upper travelling valve 33 of the upper valve assembly is seated so as to prevent pumped formation fluid above it from entering the upper pump chamber 26.

Upon shifting of the reversing valve to its lower position, and the other stage of operation of the pump, the valves of the above-described assemblies will occupy the reversed positions illustrated in FIGS. 7A to 7D. That is, lower standing valve 30 is unseated and lower travelling valve 31 is seated so as to admit formation fluid to flow past valve 30 into the lower chamber beneath piston 29 while preventing pumped formation fluid from moving past the seated valve 31 into the lower chamber. At the same time, the upper standing valve 32 is lowered into its seated position so as to prevent formation fluid from passing out through ports P, and the upper travelling valve 33 is raised from its seated position so as to permit formation fluid to be pumped past it from the lower chamber into the upper end of the housing.

Figure 1A:
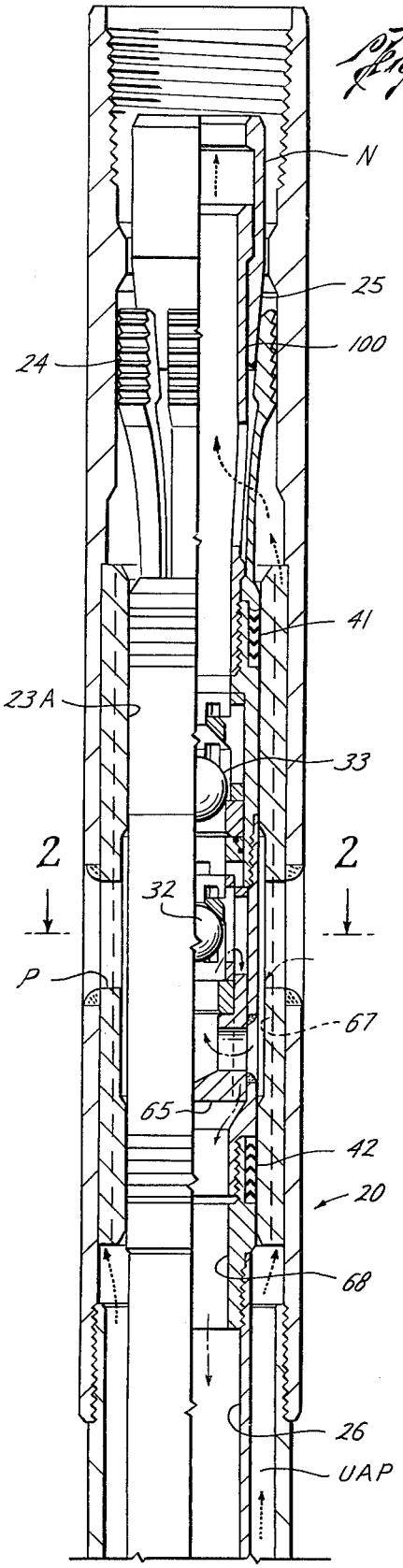

The outer diameter of the pump assembly is spaced from the inner diameter of the tubular portions of the housing, intermediate the reduced diameter portions thereof, to form upper and lower annular passageways UAP and LAP therebetween. The lower end of the lower annular passageway LAP is closed by the packing 40, and the upper end thereof is connected with the lower end of the upper passageway UAP by means of flow passages 43 formed within the reduced diameter housing portion 23B (see FIGS. 3 and 4). The upper end of the upper annular passageway UAP is connected by flow passages 44 formed in the upper reduced diameter portion 23A of the housing with an annular space about the upper end of the pump assembly. Fluid is of course free to flow from this space between the fingers and through ports in the inner body of the pump assembly, as shown in FIGS. 1A and 7A, into the open upper end of the housing.

A wall 60 extends across the lower pump chamber 27 intermediate the piston 29 therein and the lower standing and travelling valve assembly, and a wall 65 extends across the upper pump chamber assembly 26 intermediate piston 28 therein and the upper standing and travelling valve assembly. As shown in FIGS. 1D and 7D, ports P′ connect the lower section of the lower pump assembly above travelling valve 31 with the lower annular passageway LAP, whereby formation fluid pumped from the lower pump chamber will pass upwardly through the annular passageway and the connecting flow passages 43 and 44 into the upper end of the housing. The upper end of the pump assembly above travelling valve 33 of the upper valve assembly is open, so that with the standing valve 32 seated, as shown in FIG. 7A, formation fluid pumped from the upper chamber 26 flows past valve 33 and through the upper end of the pump assembly into the upper end of the housing.

Pressurized gas is supplied to the pump assembly, and thus to one or the other of the pump chambers, depending upon the position of the reversing valve within the pump assembly, by means of a tube TS which extends along the side of the housing for connection with a remote source of the gas, which ordinarily will be at the surface level of the well. Pressurized gas is exhausted from the pump assembly, and in particular from one or the other of the pump chambers, again depending upon the position of the reversing valve of the pump assembly, through another tube TE which also extends along the side of the housing. The upper end of the tube TS connects with a zone of low pressure, which, as shown in my prior patent, may be the annular space within the well above the level of the pump.

Figure 1B:
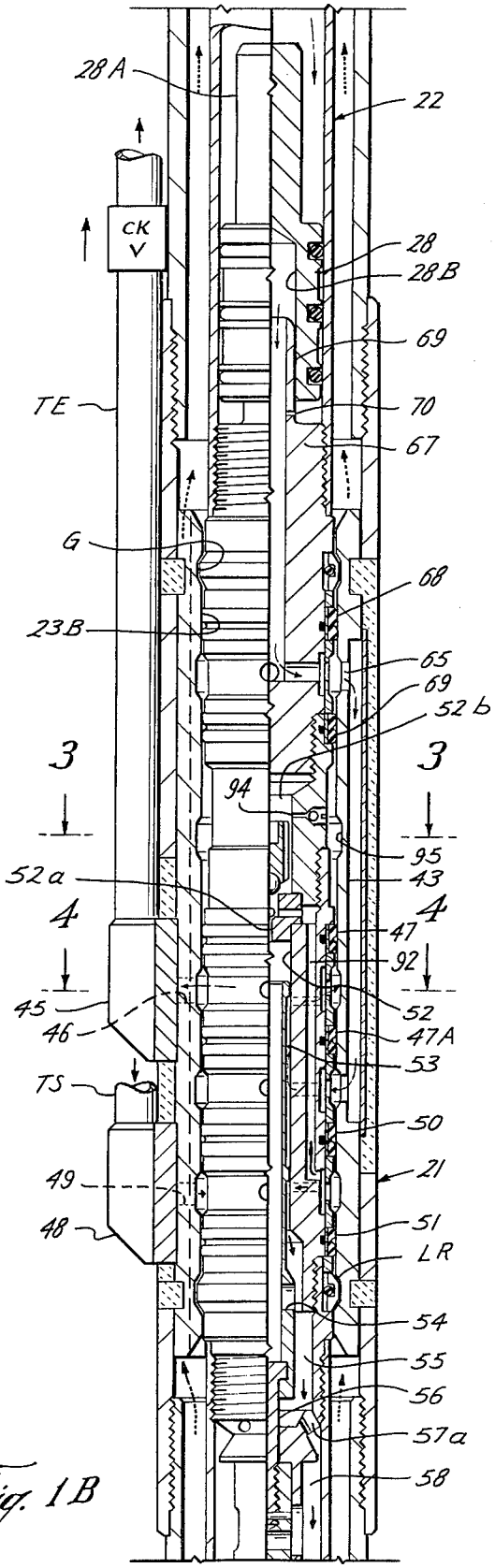
Figure 2:
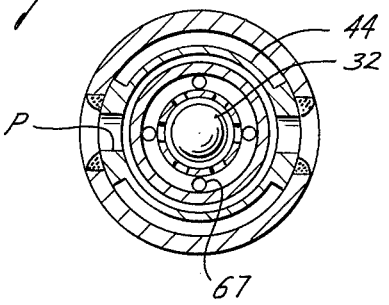
Figure 4:
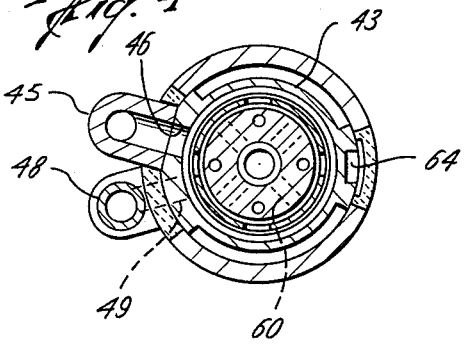
Figure 5:
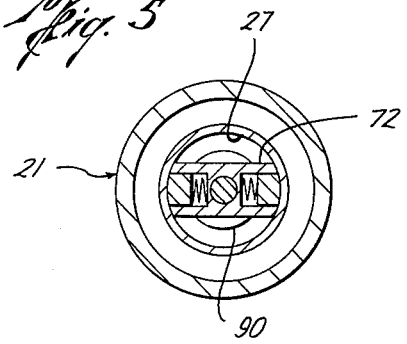
FIG. 5 is a cross-sectional view of still another portion of the pump, as seen along broken lines 5—5 of FIG. 1C.

As shown in FIGS. 1B and 4, the lower end of exhaust tube TE connects with an elbow 45 which is welded into the side of the housing for connection with a port 46 in the reduced inner diameter portion 23B thereof which crosses over the flow passages 43 therein to connect with the housing bore intermediate the sealing engagement therewith of seal rings 47 and 47A carried about the pump assembly. The supply tube TS extends below the tube TE and is connected to an elbow 48 which, as shown in broken lines in FIG. 4, is also welded into the side of the housing for connection with a port 49 in the reduced diameter portion 23B which also crosses over the flow passage 43. As can be seen from FIG. 1B, port 49 thus connects with the bore of the reduced diameter portion of the housing beneath the port 46 and intermediate the sealing engagement of seal rings 50 and 51 carried by the pump assembly with the bore of the reduced diameter portion of the housing.

The reversing valve includes a cylinder 52 extending longitudinally within the pump assembly and intermediate the pump chambers and laterally opposite the ports 46 and 49, and a spool 53 which is longitudinally reciprocable within the cylinder between the upper position of FIG. 1B and the lower position of FIG. 7B. The upper end of the cylinder is closed except for a restricted port **52*a* which leads to a dome 52*b*** in the pump assembly, the purpose of which will be apparent from the description to follow, and lower end of the cylinder is open to permit the spool to extend therethrough.

The spool is hollow to connect its open upper end with the upper end of the cylinder 52 and has a port 54 in its side toward its lower end to connect with an annular space 55 about the lower end of the spool. The lower end of the spool is connected to a rod 56 which is slidably received within a tube 57 which depends from the portion of the body assembly beneath annular space 55, and ports **57*a* through the upper end of the tube connect the space 55 with an annular passage 58** between the tube and the outer tubular body portion of the pump assembly.

The outer diameter of the pool 53 has an annular recess **55*a* thereabout intermediate upper and lower flanges 55*b* and 55*c* which are sealably slidable in cylinder 52**.

Upper ports 60 in the pump assembly connect the cylinder near its upper end with the outer side of the pump assembly opposite the ports 46 leading to the exhaust tube TE, lower ports 61 in the pump assembly connect the cylinder toward its lower end with the outer diameter of the pump assembly opposite the ports 49 leading from the supply tube TS. Additional ports 62 in the pump assembly connect the cylinder longitudinally intermediate the ports 60 and 61 with the exterior of the pump assembly opposite ports 63 in the reduced diameter portion 23B of the housing intermediate the sealing engagement therewith of seal rings 47A and 50, and ports 63 in turn connect with the lower ends of longitudinally extending flow passage 64 in the housing. The upper end of flow passage 64 leads to a port 65 which connects with the bore of portion 23B opposite side ports 66 in the pump assembly which are intermediate seals 68 and 69 for sealably engaging the bore of the reduced diameter portion 23B of the housing above and below the port 65 connecting therewith. Thus, ports 66 connect with a central flow passage 67 in the pump assembly leading into the lower end of the upper chamber beneath the piston 28 therein.

With the reversing valve in the upper position of FIG. 1B, during the first stage of the operation of the pump, pressurized gas entering ports 49 will pass through the ports 61 of the pump assembly into space 55 beneath the sealing surface of flange **55*c* about the reversing valve, and thus flow into annular passage 58 leading to the lower pump chamber 27 above piston 29. At the same time, gas is exhausted from beneath piston 28 in the upper chamber 26 through the central flow passage 67 and ports 66 in the pump assembly into the flow passage 64 in the housing for passage through the ports 63 and 53 into the annular recess 55*a* about the spool. Since the lower annular flange 55*c* of the spool is above the lower port 61, and the upper flange 55*b* thereof is above the upper port 60, gas is then free to flow through the upper end of the annular space and ports 60** into the exhaust line TE.

Conversely, when the reversing valve is shifted to its lower position, gas from the supply tube TS flows through the ports 61 into the annular recess about the reversing valve above annular flange **55*c* and below upper flange 55*b*. Since the upper flange is beneath the ports 60 and above the ports 63, gas flows from the annular recess into the flow passage 64, and thus into the central flow passage 67 leading to the upper pump chamber 26 beneath the upper piston. At the same time, gas is exhausted from the lower chamber 27 above the lower piston through the ports 57 into the space 55, and since the lower annular flange 55***c* of the spool is beneath the port 61, through the port 54 and the hollow spool. Since upper sealing flange 55*b* is below upper ports 60, exhaust gas then passes through such ports into tube TE.

At the same time gas is admitted to the lower chamber 27 to force the piston 29 downwardly therein, formation fluid beneath the piston is displaced by downward movement of the piston out through the ports P', and thus through the lower and upper annular passageways as well as the flow passages 43 and 44 into the upper end of the housing above the upper and standing valve assembly. Thus, formation fluid beneath the piston 29 will force the lower standing valve 30 downwardly to its seated position, while raising the upper travelling valve 31 to the position shown in FIG. 1B to permit formation fluid to flow therepast into the ports P'. At the same time, formation fluid in the upper end of the housing will act downwardly against the upper travelling valve 33 to cause it to be seated, as shown in FIG. 1.

At the same time, the exhaust of pressurized gas from the upper chamber beneath the piston 28 will permit formation fluid entering the upper chamber above the piston to force the piston 28 downwardly and thus continue to admit formation fluid until the piston reaches its lower position. Thus, the upper travelling valve is seated, as above described, while the lower standing valve 32 is raised to the position shown in FIG. 1A so as to permit formation fluid entering the ports P in the housing to flow into the ports P'' in the upper chamber of the pump assembly beneath lateral wall 65.

However, during the other stage of operation of the pump, wherein gas is being exhausted from the lower chamber above the lower piston 29, the upward movement of the upper piston 29 will permit the lower standing valve 30 to move upwardly to admit formation fluid entering the lower end of the housing and the lower end of the pump assembly to flow therepast and upwardly into the pump chamber beneath the piston 29, as indicated by the arrows in FIGS. 7C and 7D. At the same time, as the upper piston 28 is lifted by gas entering the lower end of the upper chamber 26, formation fluid is pumped from the upper end of the chamber above the piston to the upper end of the chamber to lift the travelling valve 33, and thus permit pump fluid to move therepast. At the same time, pump fluid acts over the upper end of upper standing valve 32 to force it downwardly and thus prevent the pump fluid from flowing outwardly through side ports P in the housing.

As shown in FIGS. 1D and 7D, the portion of the pump chamber above the wall 60 and below the piston 29 has access to the bore of the pump assembly body intermediate the valves 30 and 31 by means of an annular passageway 61 formed in the body which connects with lateral ports 62 at its lower end. When the standing valve 30 is seated and the travelling valve 31 is raised to open position, as shown in FIG. 1D, pumped formation fluid beneath the piston 29 flows through the annular passageway 61 and port 62 into the pump chamber beneath the ball 31, and past the raised ball into the portion of the chamber thereabove, but below the lateral wall 60 so that it is diverted through the port P' into the lower annular passageway LAP beneath the pump assembly and housing. Since the pressure of the pumped fluid is higher than that of the formation fluid flowing into the lower end of the pump, the standing valve 30 is held downwardly in its seated position. During the other stage of the pumping operation, wherein the lower piston 29 moves upwardly to permit the lower chamber to be filled with formation fluid, the reduced pressure in the lower portion of the pump chamber above standing valve 30 permits it to be raised by formation fluid therebelow. This formation fluid flows past the standing valve 30 to move into the chamber beneath the travelling valve 31 and through ports 62 into the annular passageway 61, and then into the chamber above the wall 60 beneath the piston 29.

As shown in FIGS. 1A and 7A, passageways 67 are formed in the pump assembly to connect the upper pump chamber beneath the wall 65 with the bore of the pump assembly above the travelling valve 33. In the stage of operation illustrated in FIG. 1A, formation fluid is free to fill the upper chamber by flowing through the ports P in the housing, ports P'' of the pump assembly body, and thus through passageway 67 into the upper pump chamber below wall 65. On the other hand, since the pump formation fluid above upper travelling valve 33 is higher than that of the formation fluid admitted through ports P, valve 33 is held downwardly in its seated position. In the other stage of operation of the pump, wherein formation fluid is pumped from the upper chamber 26, such fluid moves upwardly through the passageway 67 and into the bore of the pump assembly body beneath valve 33 so as to move such valve upwardly to unseated position and thereby permit the pump fluid to flow into the upper end of the bore in the open upper end of the pump assembly. At the same time, lower standing valve 32 drops downwardly to its seated position so as to close off the flow of formation fluid from the ports P and to the ports 66 past the valve 32 for flowing into the pump chamber 26.

The upper piston 28 is caused to decelerate as it moves upwardly into its uppermost position and downwardly into its lowermost position. For this purpose, a stem 28A on the upper end of the piston is adapted to move closely into the reduced diameter bore 68 of the pump assembly body beneath the wall 65. The lower end of the piston has an elongate recess 28B formed therein which moves closely over an upstanding projection 69 in the lower end of the pump chamber which surrounds flow passage 67 therethrough. A small port 70 formed in the projection 69 creates a dash pot effect in the annular space about the projection as the recess 28B on the lower end of the piston 28 moves downwardly over the projection.

The spool of the reversing valve is shifted between its alternate positions by a detent mechanism which includes a rod 71 axially aligned with rod 56 connected to the spool, and extending sealably through the piston 29 for connection at its lower end beneath the piston to a stop part 72 which is guidably slidable vertically within the pump chamber. Thus, when the piston 29 is moved downwardly, during the first stage of operation, it engages the stop 72 and causes the stop to move downwardly with it. As will be described to follow, the rod 71 has a lost motion with rod 56, so that downward movement of the rod 71 with the stop will in turn lower the rod 56 so as to move the reversing valve downwardly from the position of FIG. 1B to the position of FIG. 7B. On the other hand, and as will also be described, upon upward movement along the rod 71 during he second stage of operation of the pump, piston 29 will engage other parts of the detent mechanism to cause the lower rod 71 to move upwardly to engage the upper rod 56 and move the upper rod with it in order to shift the reversing valve from the position of FIG. 7B to the position of FIG. 1B.

As shown in the drawings, the tube 57 connected to and depending from the body of the pump assembly extends downwardly about the upper rod 56 to a level below the adjacent upper end of the rod 71. More particularly, a pin 74 extends laterally from the lower portion of the rod 56 into and through a slot 75 formed in the tube, the slot being longer than the diameter of the pin by a distance corresponding to the stroke of the spool as it moves between its alternate positions, such that the upper rod 56 has a corresponding limited longitudinal movement with respect to the tube.

The detent mechanism further includes a sleeve 76 which surrounds the tube 57 as well as the downward extension of the lower rod 71 below the tube. The outer end of the pin 74 is engageable by an inner annular shoulder 77 on the upper end of the sleeve 76 as the sleeve moves downwardly so as to shift the upper rod and thus the spool from its upper to its lower position as the sleeve moves downwardly. The lower end of the sleeve has an inwardly extending flange 78 which is positioned to be engaged by the upper end of the piston 29 as the piston moves upwardly so to move the sleeve upwardly with the piston in order to shift the spool upwardly from its lower to its upper position.

A coil spring 80 is disposed within an annular space between the lower rod 71 and the sleeve 76 and below the tube 57, with its lower end engaging the lower flange 78 on the sleeve and its upper end engaging a flange 81 about an intermediate portion of the lower rod upon which the lower end of the tube 57 rests in the position of the mechanism shown in FIG. 1C. The detent mechanism further includes an upwardly facing, downwardly and outwardly divergent shoulder 82 about the lower rod 71, and a downwardly facing, upwardly and inwardly convergent shoulder 83 about the inner diameter of the sleeve 76. Also, a series of balls 84 are carried within slots 85 formed in the tube for radial movement between an inner position in which the inner portions of the balls extend into an annular space between the rod 71 and the inner diameter of the tube 57, while their outer portions are removed from within an annular space between the tube 57 and the inner diameter of sleeve 76, and an outer position in which the inner portions of the ball are removed from the first-mentioned annular space and the outer portions thereof are disposed within the second-mentioned annular space. Thus, when disposed in their inner annular positions, the detents connect the rod 71 and the tube 57 for vertical movement with one another, and in their outer positions, connect the tube and the sleeve for vertical movement with one another.

In this manner, energy is stored in the spring and then released to shift the spool from one position to the other with a snap action as the lower rod is moved into its alternate positions. Thus, with reference to FIG. 1C, downward movement of the piston 29 to engage the stop 72 and move the stop downwardly with it, will pull the lower rod 71 downwardly until shoulder 72 is beneath the ball detents 84 so as to permit the balls to move to their inner positions. During this downward movement of rod 71, the flange 81 will have compressed the spring 80 and thus stored energy in it which is released when the ball detends move inwardly and thus from beneath the shoulder 83 so as to cause the sleeve 76 to move quickly downwardly. As the sleeve moves downwardly, the shoulder 77 thereon will engage the outer end of the pin 74 so as to move the upper rod 70 downwardly to the extent which this is permitted by the slot 75, and thus move the spool of the reversing valve to its lower position.

Conversely, as the piston 29 moves upwardly along the rod 71 to engage the flange 78 on the lower end of the sleeve and thus move the sleeve upwardly with it, the spring 80 will again be compressed until shoulder 83 moves about ball detents 84. At this time, the ball detents will move laterally outwardly to release the lower rod 71 so that it may be moved quickly in an upward direction by the energy stored in the spring. This upward movement of the lower rod 71 causes its upper end to engage the adjacent lower end of the upper rod 56, and thus in turn raise the upper rod to the extent permitted by upward movement of the pin 74 within the slot 75, whereby the spool of the reversing valve is moved quickly upwardly from the lower position of FIG. 7B to the upper position of FIG. 1B.

The stop 72 has a lower projection 90 which is adapted to move into a restricted portion 91 of the bore of the pump assembly just above lateral wall 60, so as to create a dash pot effect in order to decelerate downward movement of the lower piston 29 at the end of its downward stroke.

Figure 3:
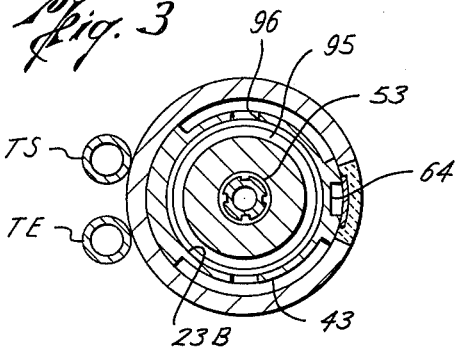

The aforementioned dome 52B in the pump assembly, with which the upper end of cylinder 52 is connected by bleed passage 52A, is in turn connected by a longitudinal passage 92 to the outer diameter of the pump assembly intermediate seal rings 50 and 51 thereabout. In this manner, pressurized gas from the tubing TS is at all times vented into the dome. Since the bleed passage 52A is quite small, very little of the pressurized gas is permitted to escape into the cylinder 52 during the stage of pump operation illustrated in FIG. 7B. On the other hand, pressurized gas within the dome is bled through a passage 94 into an annular space 95 between the pump assembly and reduced diameter portion 23B of the housing intermediate seal ring 47 and another seal ring 69 carried about the pump assembly body beneath the lateral ports therein connecting lateral ports 66 therein. As shown in FIG. 3, this space 95 is in turn connected by ports 96 with the longitudinal flow passages 43 within the reduced diameter portion of the housing. As previously described, the upper end of the passageway 43 connects with the upper annular passageway UAP, and thus with the open upper end of the housing. Consequently, and as previously described, pressurized gas is permitted to bleed into the pumped formation fluid, and thereby aerate the same in order to lessen the weight of the fluid column which must be lifted by the pressurized gas.

The alternative form of detent mechanism illustrated in FIGS. 8A and 8B is similar to that illustrated in the above-described embodiment of the invention, and may, if desired, be substituted for the previously described detent mechanism. For these reasons, corresponding parts are designated with the same reference characters, except for the addition of suffixes to the reference characters designating parts of the alternative mechanism. As previously mentioned, the primary difference resides in the use of two sets of detent means cooperable with two sets of shoulders on each of the lower rod and the sleeve of the mechanism, whereby the load imposed upon the balls may be distributed over a larger area and thus with less risk of breakage.

Thus, with reference to FIGS. 8A and 8B, the lower rod 71A, the tube 57A, and the sleeve 76A are somewhat longer than the corresponding parts of the previously described detent mechanism so as to accommodate the duplicate detent means and shoulders. The tube 57A has two sets of longitudinally spaced-apart slots 84A in each of which a set of ball detents 85A is carried for lateral movement between the outer position of FIG. 8A and the inner positions of FIG 8B. In the outer positions of the ball detents, their outer portions are engaged by downwardly facing, longitudinally spaced shoulders 83A on the inner diameter of the sleeve 76A, and in the inner positions of the ball detents, their inner portions are engaged by upwardly facing, longitudinally spaced lower rod 71A. Of course, the inner rod is formed with a pair of radially reduced portions each of which is above a shoulder 82A thereon, and the inner diameter of the sleeve is prepared with a pair of radially reduced portions above each of the shoulders 83A thereon. When in the positions illustrated and described, the ball detents cooperate with the shoulders in storing and releasing energy within the spring 80A in a manner identical to that previously described.

The embodiment of the pump illustrated in FIGS. 9A and 9B, and designated in its entirety by reference character 20A, is identical to the pump 20 previously described, except that the landable and retrievable pump assembly, which is designated in its entirety by reference character 22A, is made up of a pair of upper and lower sections 22A' and 22A" each of which includes a considerably longer pump chamber (not shown) than is provided in the unitary pump assembly previously described. As previously mentioned, each such section is separately landable and retrievable within the housing 21A of the pump, with the upper end of the lower section 22" and the lower end of the upper section 22A' having vertically interfitting parts which, when interfitted, form passageways through which formation fluid and pressurized gas may circulate during operation of the pump.

As will be apparent from the drawings, the sections interfit at an area just beneath the lower end of the upper pump chamber 26A, and just above the upper end of the reversing valve, which is generally intermediate the ends of the assembly so that the sections may be made of substantially equal lengths. More particularly, the portion of the flow passage 67A corresponding to the flow passage 67 of the previously described pump assembly is formed within a stinger 100 at the lower end of the upper section. When the upper section is lowered into interfitting relation with the lower section, as shown in FIG. 9B, the stinger 100 fits closely within a reduced diameter bore 101 in the open upper end of the lower section. More particularly, the upper enlarged end of the stinger which is received within the upper enlarged diameter portion of the bore has a shoulder 102 thereabout which lands upon a seat 103 formed in the bore of the upper end of the lower section intermediate its enlarged and reduced diameter portions.

The lower reduced diameter portions of the stinger also carries a packing 104 thereabout for sealably engaging the reduced diameter portion of the bore 101 above lateral ports 66A which connect the lower end of the bore, and thus flow passage 67A, with the exterior of the pump assembly. As in the case of the previously described embodiment, seal rings 68A and 69A are carried about the lower section of the pump assembly above and below the lateral ports 66A, so as to connect the ports 66A with ports 65A in the intermediate reduced diameter portion of the housing, and thus with a longitudinal flow passage 64A in the housing. Thus, with the upper section of the pump assembly interfitted with the lower section, as shown in FIG. 9B, the two sections of the pump assembly will function and cooperate in the same manner as the unitary pump assembly previously described.

The upper end of the bore 101 in the lower section 22A" of the pump assembly has a fishing neck 110 for cooperation with a suitable wireline running tool during landing and retrieving. It will be understood that the upper end of the body of the upper section 22A' of the pump assembly would also be prepared with a fishing neck, and preferably with a hold down mechanism identical to that described in connection with the upper end of the pump assembly of the previously described pump.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A double acting, gas operated pump for lifting formation fluid from a well, comprising a housing connectible to the lower end of a production string suspended within the well, means forming upper and lower pump chambers within the housing, a piston sealably slidable in each chamber, the lower chamber on one side of the piston therein connecting with the lower end of the housing and the upper chamber on one side of the piston therein connecting with the upper end of the housing whereby each receives formation fluid from the well, and each chamber on the other side of the piston therein connecting with the upper end of the housing to deliver formation fluid into the production string, valve means controlling the flow of formation fluid into and out of each pump chamber in order to prevent such fluid from being pumped therefrom as it is being supplied thereto and prevent such fluid from being pumped therefrom as it is being supplied thereto and prevent such fluid from being supplied thereto as it is being pumped therefrom, means including a reversing valve having a spool for supplying gas from a remote source to the first chamber on the other side of the piston therein while exhausting gas from the second chamber on the other side of the piston therein to a zone of relatively low pressure outside the production string, when the spool is in a first position, and for supplying gas from the remote source to the second chamber on said other side of the piston therein while exhausting gas from the first chamber on the other side of the piston therein to said zone of relatively low pressure when the spool is in a second position, whereby said pistons are caused to reciprocate in order to pump formation fluid from one chamber while the other chamber is being filled therewith, means for shifting said spool between its first and second positions in response to reciprocation of said piston, including a rod connected to the spool and extending through the piston, and means including spring means in which energy is stored and then released to shift the spool into each of its positions with a snap action as the piston moves into each of its opposite positions, the other piston being free of the rod.

2. A pump of the character defined in claim 1, including means including conduit means within the housing for bleeding a small amount of gas from the supply means to the formation fluid in the production string.

3. A pump of the character defined in claim 1, wherein the reversing valve is located intermediate upper and lower pump chambers, and the lower chamber on one side of the piston therein is connected with the open upper end of the housing by a bypass around the reversing valve.

4. A pump of the character defined in claim 1, wherein the gas is supplied to and exhausted from the upper side of the piston in the lower pump chamber, and the rod connecting with the spool is slidable within the piston in the lower pump chamber.

5. A pump of the character defined in claim 1 wherein the reversing valve includes a cylinder which is closed at one end and open at the other end to received the spool for reciprocating therein, said cylinder having a first port connectible with the gas supply, and a second port connecting with the exhaust tube, said spool being hollow to connect at one end with the closed end of the cylinder, and having upper and lower flanges thereabout which are sealably slidable within the cylinder and which form a first annular space about the spool between the flanges and a second annular space thereabout to one side of the second flange, the other end of the spool and the second annular space leading to the upper side of the piston, said other end of the spool connecting with the second port and the first port connection with the first annular space, to exhaust gas from upper side of the piston when the spool is in one position, and the first port connecting with the second annular space and the second port connecting with the first annular space to supply gas to the upper side of the piston when the spool is in the other position.

6. A pump of the character defined in claim 1, wherein the reversing valve includes a cylinder which is closed at one end and open at the other end to receive the spool for reciprocating therein, said cylinder having a first port connectible with the gas supply, a second port connecting with the exhaust, and a third port connecting with the other side of the pistons, said spool being hollow to connect at one end with the closed end of the cylinder, and having upper and lower flanges thereabout which are sealably slidable within the cylinder and which form a first annular space about the spool between the flanges and a second annular space thereabout to one side of second flange, the other end of the spool and the second annular space leading to the other side of the other piston, the other end of the spool connecting with second port and the first and third ports being connected by the first annular space in order to exhaust gas from the one piston and to supply gas to the other piston, when the spool is in one position, and the first port connecting with the lower annular space and the second and third ports being connected by the first annular space in order to supply gas to the one piston and exhaust gas from the other piston, when the spool is in the other position.

7. A double acting, gas operated pump lifting formation fluid from a well, comprising a housing connectible to the lower end of a production string suspended within the well, a pump assembly which may be lowered into and raised from a landed position within the housing, said assembly having upper and lower pump chambers formed therein, a piston sealably slidable in each chamber, means operable upon landing of the pump assembly within the housing to connect each chamber on one side of the piston therein with the exterior of the housing to receive formation fluid from the well, and with the upper end of the housing to deliver formation fluid into the production string, valve means within the pump assembly for controlling the flow of formation fluid into and out of each pump chamber in order to prevent such fluid from being pumped therefrom as it is being received therein and prevent such fluid from being received therein as it is being pumped therefrom, means including tubes extending along the exterior of the housing for supplying a pressurized gas to the interior thereof or exhausting gas therefrom to a zone of relatively low pressure outside the production string, means including a reversing valve having a spool within the pump assembly which, when in a first position, delivers gas supplied through one of said tubes to the upper chamber on the other side of the piston therein while exhausting gas from the lower chamber on the other side of the piston therein to the other of said tubes, and, when in a second position, delivers gas supplied through said one tube to the lower chamber on said other side of the piston therein while exhausting from the upper chamber on said other side of the piston therein to said other tube whereby said pistons are caused to reciprocate in order to pump formation fluid from one chamber while the other chamber is being filled therewith, for shifting said spool between its first and second positions in response to reciprocation of said piston, including a rod connected to the spool and extending through the piston, and means including spring means in which energy is stored and then released to shift the spool into each of its positions with a snap action as the piston moves into each of its opposite positions, the other piston being fee of the rod.

8. A pump of the character defined in claim 7, including means including conduit means within the pump assembly for bleeding a small amount of gas from the supply means to the formation fluid in the production string.

9. A pump of the character defined in claim 7, wherein the pump assembly is lowered into and raised from landed position as a whole.

10. A pump of the character defined in claim 7, wherein the pump assembly comprises a pair of sections each of which has a pump chamber formed thereon and is separately lowered into and raised from landed position, the upper end of the lower section and lower end of the upper section having vertically interfitting parts which define passages through which the formation fluid and gas circulate.

11. A pump of the character defined in claim 7, wherein the reversing valve includes a cylinder which is closed at one end and open at the other end to receive the spool for reciprocating therein, said cylinder having a first port connectible with the gas supply, a second port connecting with the exhaust, and a third port connecting with the other side of the pistons, said spool being hollow to connect at one end with the closed end of the cylinder, and having upper and lower flanges thereabout which are sealably slidable within the cylinder and which form a first annular space about the spool between the flanges and a second annular space thereabout to one side of second flange, the other end of the spool and the second annular space leading to the other side of the other piston, the other end of the spool connecting with second port and the first and third ports being connected by the first annular space in order to exhaust gas from the one piston and to supply gas to the other piston, when the spool is in one position, and the first port connecting with the lower annular space and the second and third ports being connected by the first annular space in order to supply gas to the one piston and exhaust gas from the other piston, when the spool is in the other position.

12. In a gas operated pump compaising a body which includes a chamber having a piston longitudinally reciprocable therein, means for alternately admitting fluid to be pumped to the chamber on one side of the piston, as the piston moves in one longitudinal direction toward one alternate position, and displaying fluid from the chamber on said one side of the piston, as the piston moves in the opposite longitudinal direction toward another alternate position, and means including a reversing valve having a spool shiftable between a first position for supplying gas to the chamber on the other side of the piston to move it in the opposite direction, and thereby displace fluid from the chamber, and a second position for exhausting gas therefrom to permit said piston to be moved in the one longitudinal direction by fluid which is admitted to the chamber; an improved mechanism for shifting the spool between its first and second positions in response to movement of said piston into its alternate positions, said mechanism comprising a first rod on which the piston is carried for longitudinal movement with respect thereto, said first rod having a stop thereon which is engaged by the piston so as to move said first rod with said piston as said piston moves to its other position, a second rod arranged in end-to-end, coaxial relation with the first rod and connected to the spool for shifting said spool between said first and second positions, a tube connected to and extending from the pump body to surround the adjacent ends of the rods, means on the tube and second rod limiting longitudinal movement of the second rod with respect to the tube to a distance corresponding to the longitudinal movement of the spool between its first and second positions, a sleeve surrounding the tube and the extension of the second rod from the tube, means on the second rod which is engageable by the sleeve to shift the spool from its first to its second position, as the sleeve moves in said other longitudinal direction, means on the sleeve which is engageable by the piston to move the sleeve with the piston as the piston moves in said one longitudinal direction, whereby the spool may be shifted from its second to its first position, spring means acting between the first rod and sleeve to urge the first rod in said one longitudinal direction and the sleeve in said other longitudinal direction, shoulder means on the first rod facing in said one longitudinal direction, shoulder means on the sleeve facing in said other longitudinal direction, and detent means carried by the tube for lateral movement between a first position in which it is engaged with the shoulder means on the sleeve but disengaged from the shoulder means on the first rod, and a second position in which the detent means is engaged with the shoulder means on the first rod but disengaged from the shoulder means on the sleeve, so that energy is stored in the spring and then releases to quickly move said sleeve in said other longitudinal direction and thus shift said spool from its first to its second position, as the first rod is moved with the piston in said other longitudinal direction, the movement of said sleeve with said piston in said one longitudinal direction again storing energy in the spring until the detent means moves from its second to its first position to release said energy to quickly move said first rod in said one longitudinal direction and thus shift said spool from its second to its first position.

13. A mechanism of the character defined in claim 12, wherein there are a pair of detent means spaced longitudinally of the tube, and a pair of shoulder means spaced longitudinally of each of the first rod and sleeve.

14. A mechanism of the character defined in claim 12, wherein a pin on the second rod extends through a slot in the tube which is longer than the pin by a distance equal to the limited longitudinal movement of the spool, the outer end of said pin being engageable by the sleeve to shift the spool from its first to its second position.

* * * * *